United States Patent [19]

Lederer

[11] 4,381,613

[45] May 3, 1983

[54] SKI BOOT

[76] Inventor: Josef Lederer, Post St. 9, D-8069 Jetzendorf, Fed. Rep. of Germany

[21] Appl. No.: 221,633

[22] Filed: Dec. 31, 1980

[30] Foreign Application Priority Data

Jan. 17, 1980 [DE] Fed. Rep. of Germany ..... 3001633

[51] Int. Cl.[3] ..... A43B 5/04

[52] U.S. Cl. ..... 36/121

[58] Field of Search ..... 36/117, 118, 119, 120, 36/121, 50

[56] References Cited

U.S. PATENT DOCUMENTS

| | | | |
|---|---|---|---|
| 3,721,023 | 3/1973 | Kastinger | 36/120 |
| 3,775,871 | 12/1973 | Serko | 36/121 |
| 4,152,849 | 5/1979 | Frechin et al. | 36/120 |

*Primary Examiner*—Patrick D. Lawson

*Attorney, Agent, or Firm*—Toren, McGeady and Stanger

[57] ABSTRACT

In a ski boot comprising a forward heel cup and an ankle cuff mounted pivotably, at said forward heel cup, around a transverse axis situated in front of the Achilles tendon line of the shoe transversely to the longitudinal direction of the shoe and defined by sideward hinge points, the ankle cup being fastenable to the shoe by means of support devices in a downhill skiing position in which said ankle support forces the lower leg into a forward-inclined downhill skiing position, it is suggested that by the shifting of the transverse axis (Q) out of a downhill skiing position (FIG. 1) into a resting position (FIG. 2), the support devices (32, 31) can be taken out of service in such a way that the lower leg can revert, with said ankle cuff (16), from the downhill skiing position into a resting position.

22 Claims, 7 Drawing Figures

SKI BOOT

The invention relates to a ski boot comprising a forward heel cup and an ankle cuff which is mounted pivotably, at the forward heel cup, around a transverse axis situated in front of the heel-Achilles tendon line of the shoe transversely to the longitudinal direction of the shoe and defined by sideward hinge points, this ankle cuff being fastenable to the shoe by means of support means in a downhill skiing position, in which position the ankle support forces the lower leg into a forward-inclined downhill skiing position.

Such ski boots in which the ankle cuff forms a rearward limit in the shoe, are required by the modern technique of downhill skiing.

It has been ascertained that the continuous stress of the lower leg in the forward-inclined downhill skiing position even in periods other than those of downhill skiing, that is to say, when the skier is standing still, walking or riding on a mechanical conveyance, can lead to fatigue which then, during a later skiing, leads to reduced performance and the heightened danger of accidents.

At the basis of the invention there is, therefore, the task to make possible, by simple means, a re-adjustment of the ankle cuff, such re-adjustment permitting the skier, during the periods other than those of downhill skiing, to revert with the lower leg from the forward-inclined downhill skiing position into a resting position.

For the solution of this task it is suggested according to the invention that the support means can be taken out of service by the shifting of the transverse axis from a downhill skiing position to a resting position in such a way that the lower leg can revert from the downhill skiing position into the resting position when the support means are taken out of service.

The support means according to a first embodiment of the invention can comprise rearwards of the transverse axis a substantially upwards-oriented stop at the forward heel cup and a substantially downwards-oriented stop at the ankle cuff.

When in the downhill skiing position of the transverse axis these stops rest against one another, this defines the downhill skiing position of the ankle cuff in relation to the forward heel cup; the ankle cuff cannot pivot back any further and the lower leg is held tight in its forward-inclined downhill skiing position. If now, as per the invention, one can shift the transverse axis, that is to say the axis defined by the hinge points, out of its downhill position further upwards, this signifies that the stops engage with each other only after further rearwards shifting of the ankle cuff around the transverse axis, so that the lower leg can revert from the downhill skiing position into a resting position. The upward-oriented stop of the forward heel cup can be constituted by a step on the outer surface of said forward heel cup. This step is formed preferably in the area of the heel-Achilles tendon line of the forward heel cup, but can, if necessary, also extend into the area of the transverse axis.

The downwards-oriented stop of the ankle cuff can be formed by the lower edge of the ankle cuff.

According to another embodiment, the support means are formed by, on one hand, the inner curved surface of the ankle cuff extending between the hinge points of the ankle cuff at the forward heel cup, and, on the other hand, the outer curved surface of the forward heel cup extending between these hinge points. In this way, the inner curved surface is brought to rest against the outer curved surface of the forward heel cup during the backwards tilt of the ankle cup around the transverse axis, in any case then when, in the area where these curved surfaces rest against each other, a curved line of the curved outer surface, which line extends in a plane containing the transverse axis, increases in length with the increasing lowering of the rearward part of this plane. Thanks to the possibility of shifting the transverse axis one can now change the angle positions in which the support devices become functional, that is to say, the angle position in which the inner curved surface of the ankle cuff, by resting against the outer curved surface of the forward heel cup, blocks a further backward tilting movement of the ankle cuff. One can thus make possible a further backward tilting movement of the ankle cuff around the transverse axis by the upward or backward adjustment of the transverse axis, and thus permit the lower leg to return to the resting position.

The hinge points of the ankle cuff at the forward heel cup can be movable along circular paths, whereby a simultaneous horizontal and vertical repositioning of the transverse axis is made possible, that is to say, an upwards and backwards movement of the transverse axis during the transfer of the axis into the resting position, and a downwards and forwards movement of the transverse axis during its transfer into the downhill skiing position.

In order to accomplish by simple means the movability of the hinge points and, thus, of the transverse axis in relation to the forward heel cup, one can provide the hinge points of the ankle cuff at the rearward parts of these hinge points with double-armed guides, which guides, in turn, are hinged onto guide bearings at the forward heel cup, and which guides, with their front parts, can be fastened at the forward heel cup at least in such a position as corresponds to the downhill skiing position of the transverse axis.

A particularly efficient and simple manner of fastening the guides in their position corresponding to the downhill skiing position of the transverse axis can be obtained by constructing the guides as parts of an instep strap in such a way that when the instep strap is strapped closed over the seat surface of the instep, the transverse axis is in the downhill skiing position. In order to be able to transfer the transverse axis into the resting position, one need only detach the instep strap. By the rearward pressure of the lower leg on the ankle cuff, the guides formed by the instep strap parts pivot by themselves in such a way that the transverse axis assumes the resting position.

In the embodiment according to the invention, the forward heel cup can be constructed in a known way with ankle support plates which are enclosed by the ankle cuff.

The accompanying figures elucidate the invention with the help of an example of embodiment.

Figure 1:
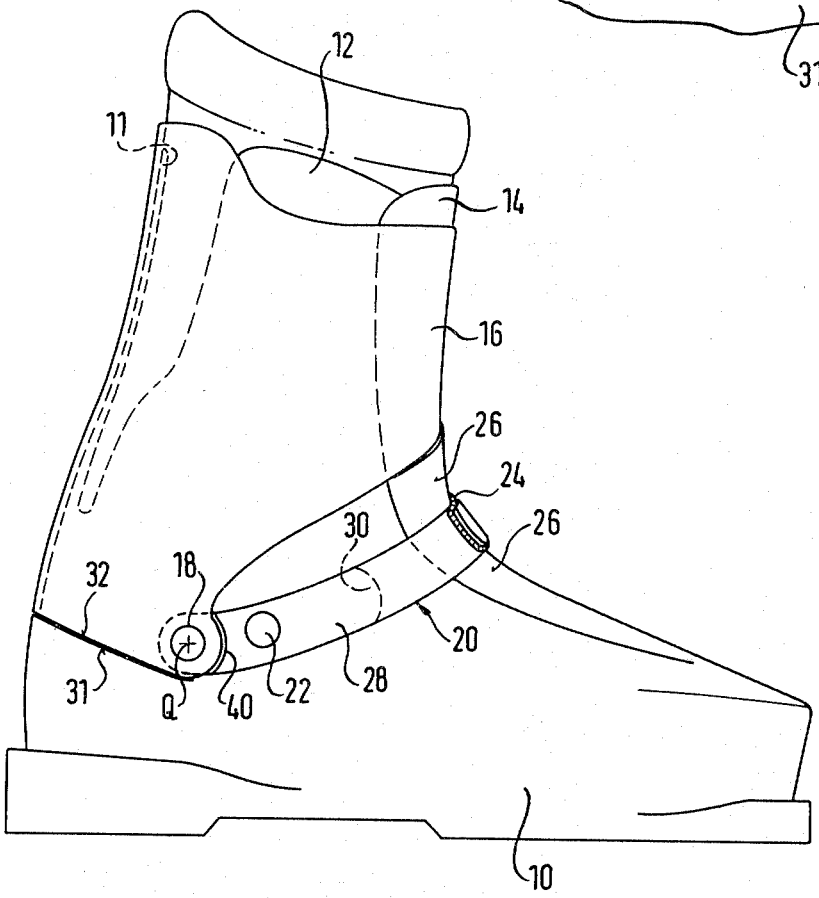
FIG. 1 represents a ski boot in which the ankle cuff is fastened in the downhill skiing position and FIG. 2 shows a ski boot according to FIG. 1, in which the ankle cuff can be tilted back from the downhill skiing position of FIG. 1 into a resting position.

In FIG. 1 a forward heel cup is designated by 10.

The forward heel cup has ankle support plates 11,12 and a tongue 14. The ankle support plates 11, 12 and the tongue 14 are enclosed by an ankle corset 16 which can be opened and closed to a ring by means of a conventional toggle-type fastener. The ankle corset 16 is tiltably hinged onto hinge points 18 at the forward heel cup 10 around a transverse axis Q defined by the hinge points 18. The hinge points 18 are now not attached immediately at the forward heel cup 10 but rather are fastened to the parts of an instep strap 20 which parts are hinged into bearings 22 at the forward heel cup 10. The instep strap 20 can be closed by means of a closing device 24 and can be stretched over a seat surface 26 in the area of the instep. Of the parts of the instep strap 20 there is only one represented in FIG. 1 and designated with 28. This part 28 is stiffened by means of a reinforcement plate 30 on the side of the part facing the forward heel cup. The instep strap part 28 can therefore be considered a double-armed guide 28 which is mounted in a guide bearing 22 at the foward heel cup 10 and which carries, at its rearward part, the hinge point 18 for the ankle cuff 16. The same applies for the other side of the ski boot, not represented here. At the outer surface of the forward heel cup 10 there is formed an upwards-oriented stop step 31 rearwards of the transverse axis Q. Against this stop step 31 there rests in the position of FIG. 1 a downwards-oriented stop edge 32 of the ankle cuff 16. It should now be assumed that in FIG. 1, the instep strap is strapped tight. In the position of the ankle cuff 16 according to FIG. 1, the lower leg of the skier is inclined forwards in conformance with the usual forward-leaning stance of the lower leg which is desirable in the modern technique of downhill skiing. In this procedure the ankle cuff 16 serves as backward limit; from the position drawn in FIG. 1 it cannot tilt further backwards in a counterclockwise direction around the transverse axis Q. For the stop edge 32 hits against the stop step 31 and a tilting-up of the hinge point 18 around the guide bearing 22 is not possible because the instep strap 20 is strapped.

Figure 2:
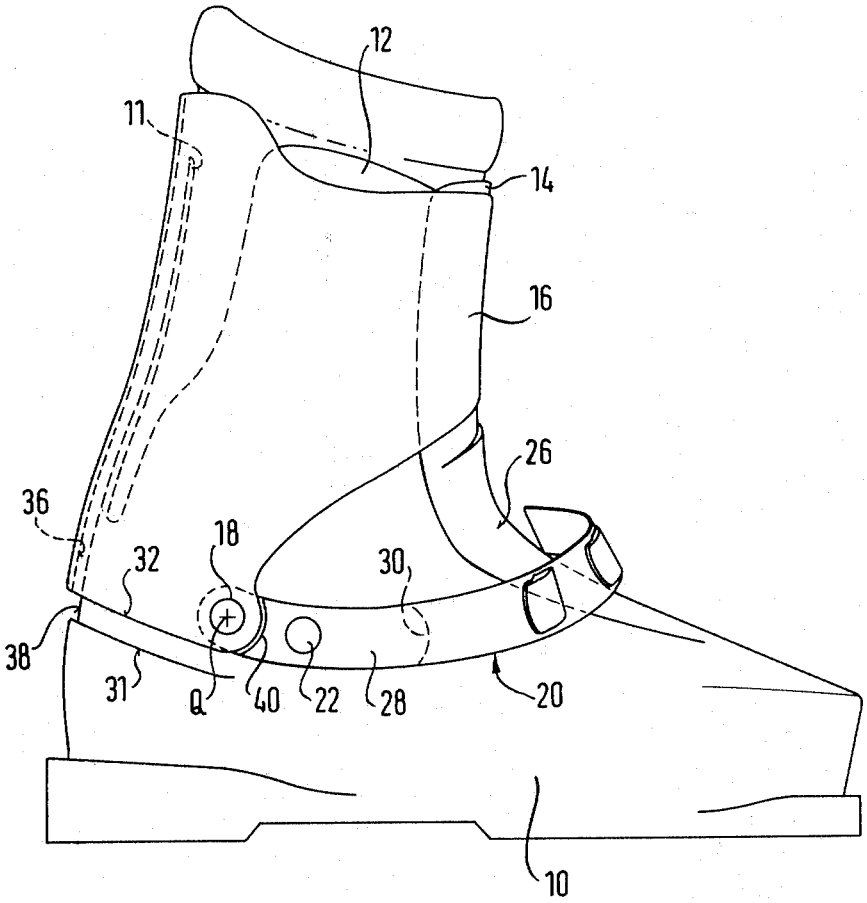

In FIG. 2 the instep strap 20 is detached and the double-armed guide 28 is turned clockwise around the guide bearing 22. Thereby the transverse axis Q, defined by the hinge points 18 of the ankle cuff 16 at the guides 28, has migrated upwards in relation to the downhill skiing position according to FIG. 1 into the resting position according to FIG. 2. The tilting position of the ankle cuff 16 around the transverse axis Q is substantially still the same at first, as per FIG. 1. One recognizes however that because of the upward movement of the transverse axis Q the stopping edge 32 has gained some distance from the stop step 31 so that the ankle cuff 16 can be tilted further back around the transverse axis Q until the stopping edge 32 and the stop step 31 hit against each other again. This signifies that in FIG. 2, in comparision to FIG. 1, the support devices have been put out of service, so that the ankle cuff 16 can be tilted back around the transverse axis Q by a backwards pressure of the lower leg, the lower leg thereupon assuming a resting position. The ends of the instep strap parts on the side of the buckles, that is to say the ends of the double-armed guides 28, simultaneously migrate over the forward heel cup 10 downwards of the seat surface 26. They can hang loosely, but if of appropriate length, they can remain engaged by means of the fastener 24 in the resting position.

Even if the stop step 31 and the stop edge 32 were not present, the ski boot would substantially have the same behavior as described in reference to FIGS. 1 and 2. The function of the support devices would then be taken over by the inner curved surface 36 of the ankle cuff and the outer curved surface 38 of the forward heel cup under the condition that the inner curved surface 36, when the ankle cuff 16 tilts backwards around the transverse axis Q, is increasingly pressed against the curved surface 38 as a consequence of the fact that the circular length of the outer curved surface 38 increases downwards, thereby bringing to a standstill the backward tilting movement of the ankle cuff 16. It can easily be seen that even under these conditions, a further backward tilting of the ankle cuff around the transverse axis Q is made possible by the upwards migration of the transverse axis out of the position of FIG. 1 into the position of FIG. 2, because the transverse axis Q, during the upward movement from the position of FIG. 1 into the position of FIG. 2, is also simultaneously shifted backwards.

The edge 40 in FIGS. 1 and 2 indicates that the part of the instep strap segment 28 functioning as guide, which part grips under the ankle cuff 16, can be constructed thinner below the ankle cuff 16 than outside of the area of the ankle cuff in such a way that the surfaces of the ankle cuff and the instep strap parts lead flush into one another.

Figure 3:
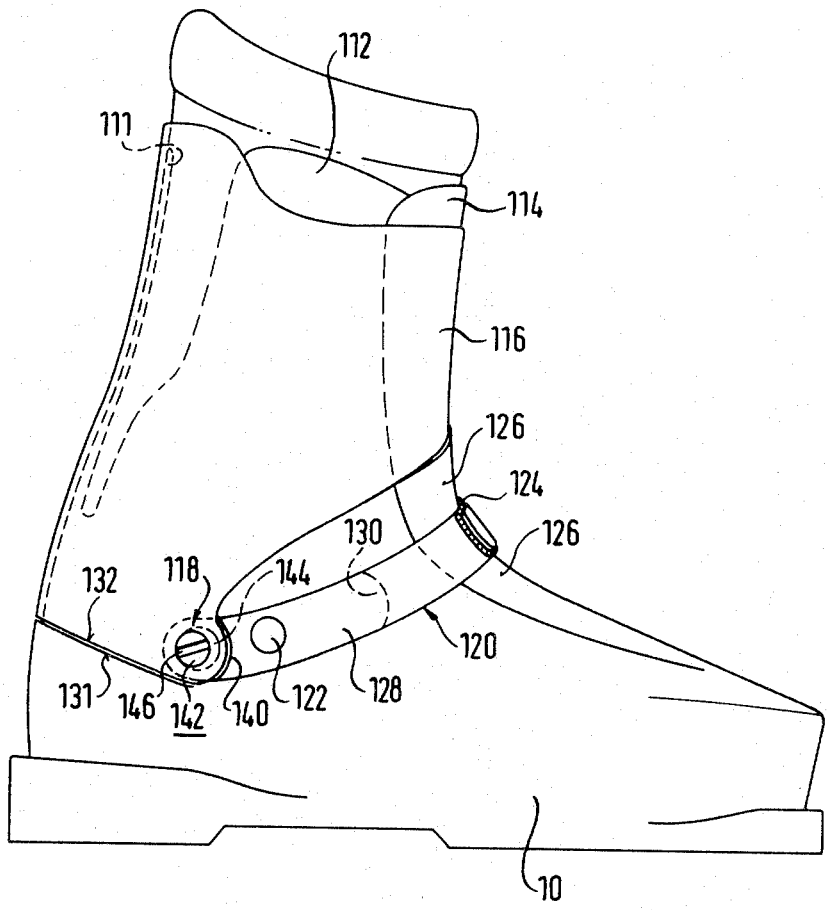
FIG. 3 shows a variant embodiment.

FIG. 3 shows a variant embodiment. This variant embodiment corresponds substantially to the embodiment according to FIGS. 1 and 2. Analogous parts are provided with the same reference numerals as in FIGS. 1 and 2 increased by the number 100.

The hinge points 118 are constructed in a manner varying from the embodiment according to FIGS. 1 and 2. On the part of the short arm of the double-armed guide 128 forming the instep strap 120, there is an eccentric pin 142 mounted turnably around a bolt axis. The ankle cuff 116 is turnably mounted on the eccentric part 144 of the eccentric pin 142; the axis of the eccentric part is offset in relation to the axis of the bolt. The outer end of the eccentric pin 142 is provided with a slot 146 so that the eccentric pin can be turned by means of a tool, for example by means of a coin. By the turning of the eccentric pin 142, there is a change in the position of the transverse axis Q which coincides with the axis of the eccentric part. In this manner, the inclination of the ankle cuff 116, in which the stop 132 hits against the stop step 131, can be varied. Independently of that, a shifting of the transverse axis can of course be made possible by the detachment of the instep strap 120. Upon the renewed strapping of the instep strap, the transverse axis once again assumes the old position which corresponds to the desired inclination of the ankle cuff 116, that is to say to the desired forward leaning stance.

The eccentric pin 142 is mounted in the guide 128 in such a way as to be so difficultly movable around the bolt axis that there can be no shifting by itself around this bolt axis in relation to the guide 128. Other possibilities of shifting the transverse axis Q for making it firm in relation to the guide 128 are conceivable.

The possibility represented in FIG. 3 is especially preferred for reasons of handling convenience insofar as the leaning-backwards of the ankle cuff from the resting position to the downhill skiing position can be undertaken without elaborate adjustment operations on the eccentric pin 142 but, rather, by simply applying and tightening the instep strap 120.

Figure 4:
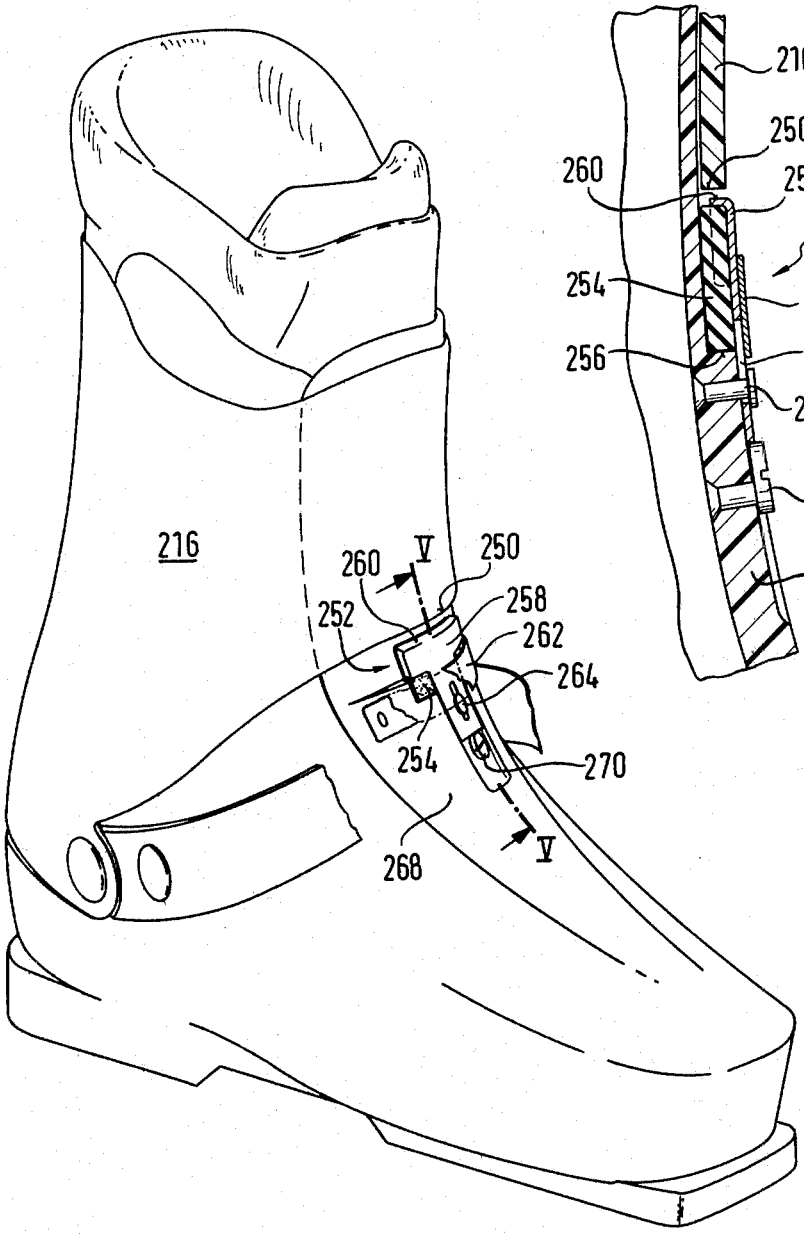
FIGS. 4 and 5 show variant embodiments.
Figure 5:
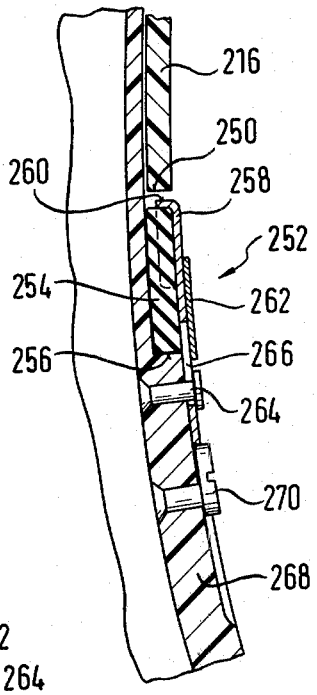

In FIG. 4 it is shown that the forward bottom edge 250 of the ankle cuff 216 can function in connection with a pad construction 252 in order to set an elastically increasing stop effect against the forward movement of the lower leg. The pad construction 252 is represented in detail in FIG. 5. One recognizes an elastic pad body 254 which is supported at a step 256 of the tongue. A pad plate 258 pushes elastically onto the pad body 254 with its bent upper edge 260. The pad plate 258 extends under a covering plate 262 which secures the entire pad construction against lifting by the tongue. For guidance there serves furthermore a guidance rivet 264 which traverses an oblong hole 266 of the pad plate 258. To the tongue 268 there is furthermore turnably mounted an eccentric member 270 which rests against the bottom edge of the pad plate 258. Turning this eccentric member makes it possible to secure the position in which the pad plate 258, after elastic deformation of the pad body 254, finally pushes against a rigid stop and thus prevents a further inclination of the stance.

Figure 6:
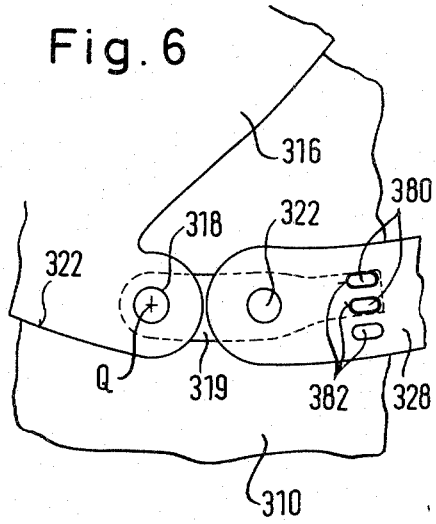
FIG. 6 shows a complement to FIG. 1 in the area VI of FIG. 1.

In FIG. 6 there is represented a particularly interesting complement to FIG. 1, wherein analogous parts are designated with the corresponding reference numerals increased by the number 300.

At the forward heel cup 310 there is mounted in the guide bearings 322 a guide 319 in the form of a substantially flat plate piece. This guide 319 has in its rearward part the hinge point 318 for the ankle cuff 316. In the guide bearing 322 there is turnably mounted on the guide 319 in relation to the guide 319 an instep strap segment 328. The construction of the instep strap part 328 and of the guide 319 is represented in detail in FIG. 7. As is inferred from FIG. 7, there are formed on the guide 319 in this example two detents 380 which are punched out of the plate piece of the guide 319 and bent up. The detents 380 are designed to engage with, for instance, three slots 382 of the instep strap segment 328. In this manner, the angle adjustment of the instep strap segment 328 can be altered in relation to the guide 319. This means that with the same adjustment of the instep strap in relation to the forward heel cup 310, the position of the hinge points 318 can be varied as is represented in FIGS. 1 and 2. It thus becomes possible to adjust, with a constant position of the instep strap, different downhill skiing positions as well as one or more resting positions of the transverse axis Q. In this process it is particularly advantageous that the instep strap can be led and strapped over the seat surface in the instep area in the resting position as well, so that there is no danger from loosely projecting parts in the resting position.

The guide situated on the opposite side of the ski boot and the instep strap segment belonging to it can be constructed correspondingly. It is advantageous for the instep strap segments to consist of a material making them relatively resistant to bending in their own plane but enabling them, however, to be bent out of their plane, for instance a hard plastic or a hard rubber mixture.

The free ends of the instep strap segments can be connected to each other and be stretched by means of conventional catches of adjustable length.

Figure 7:
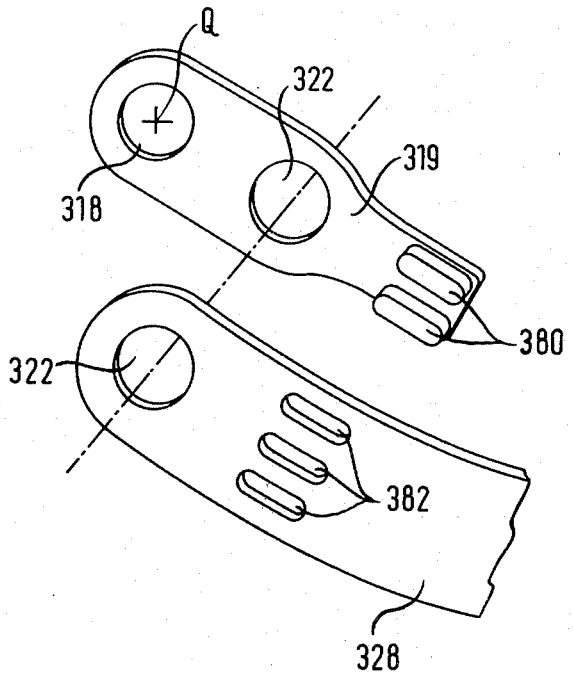
FIG. 7 is an exploded representation of parts of FIG. 6.

For the adjustment of the hinge points 318 and thus of the transverse axis in an embodiment according to FIGS. 6 and 7, the most efficient method of proceeding is such that, with the adjustment of the instep strap segment 328 through the guide 319 remaining unchanged, one first undertakes the pivoting around the bearing 322 in such a way that an easy-moving adjustment is possible by means of the long lever arm of the instep strap segment 328. Once the transverse axis Q has been adjusted to the desired position, the position of the instep strap segment 328 in relation to the guide 319 can be corrected in such a way that the instep strap again extends in its normal position over the seat surface 26 of the instep area as per FIG. 1, the normal position corresponding as a rule to the shortest path between the bearings 322 to both sides of the ski boot.

I claim:

1. Ski shoe comprising a forward heel cup and an ankle cuff pivotally mounted on said forward heel cup around a transverse axis (Q) situated in front of the Achilles heel tendon line of the shoe and extending transversely of the longitudinal direction of shoe and defined by sidewardly extending hinge points, support devices for holding said ankle cuff on said boot in a downhill skiing position, in which position said ankle cuff forces the lower leg into a forwardly-inclined downhill skiing position, characterized in that said hinge points (18) and the transverse axis (Q) are adjustably arranged, guide bearings (22) secured to said forward heel cup (10) and spaced from said transverse axis (Q), a guide (28) pivotally mounted on each said guide bearing (22), each said hinge point (18) secured to one of said guides (28), said hinge points (18) defining the transverse axis (Q) being shiftable out of the downhill skiing position (FIG. 1) into a resting position (FIG. 2), by shifting said guides (28) above said guide bearings (22) with said support devices (32, 31) being shifted in such a way that the lower leg supported by said ankle cuff 16 is movable from said downhill skiing position into a resting position.

2. Ski shoe according to claim 1, characterized in that said support devices (32, 31) comprise, rearwards of said transverse axis (Q), a substantially upwardly-oriented stop (31) on said forward heel cup (10) and a substantially downwardly-oriented stop (32) on said ankle cuff (16), and in that the resting position of said transverse axis (Q) is spaced upwardly from the downhill skiing position of said transverse axis (Q).

3. Ski shoe according to claim 2, characterized in that said upwardly-oriented stop (31) of said forward heel cup (10) is formed by a step along the outer surfaces of said forward heel cup (10).

4. Ski shoe according to claim 3, characterized in that said step is constructed in the area of the Achilles heel tendon line of said outer surface of said forward heel cup (10) and extend substantially horizontally into the area of said transverse axis (Q).

5. Ski shoe according to claim 2, 3 or 4, characterized in that said downwardly-oriented stop (32) of said ankle cuff (16) is formed by the bottom edge of ankle cuff (16).

6. Ski shoe according to claim 1, 2, 3 or 4, characterized in that said support devices include an inner curved surface (36) of said ankle cuff (16), said inner curved surface extends along the forward heel cup (10) between said hinge points (18) of said ankle cuff (16), and an outer curved surface (38) of said forward heel cup (10), said outer surface extending between said hinge points (18), the length of a curved segment of said curved outer surface which is situated in a plane containing said transverse axis (Q) increasing, in the downhill skiing position the area of contact of said curved surfaces (36, 38), being increased with the lowering of the rearward part of said plane, and the resting position of said transverse axis (FIG. 2) is situated above to the rear of the downhill skiing position of said transverse axis (FIG. 1).

7. Ski shoe according to claim 6, characterized in that hinge points (18) are movable along circular paths.

8. Ski shoe according to claim 7 wherein said guide bearings are double-armed guides (28) with said hinge points (18) affixed to the rearward parts of said double-armed guides (28), said guides being hinged to said guide bearings (22) and said hinge points being capable of being fastened with their forward parts to said forward heel cup at least in one position corresponding to the downhill skiing position of said transverse axis (Q).

9. Ski shoe according to claim 8, including an instep strap with said guides (28) formed as parts of said instep strap, an instep seat (26) on said forward heel cup, said transverse axis (Q) being in the downhill skiing position (FIG. 1) when said instep strap (20) is closed and strapped over said instep seat (26).

10. Ski shoe according to claim 9, characterized in that said forward heel cup has ankle support plates (11, 12, 14) enclosed by said ankle cuff (16).

11. Ski shoe according to claim 1, 2, 3 or 4, characterized in that said transverse axis (Q) is adjustable to different downhill skiing positions, in order that the forward-inclined downhill skiing position of the lower leg can be varied as desired.

12. Ski shoe according to claim 11, characterized in that said hinge point (118) is formed by an eccentric pin (142), mounted turnable around a bolt axis, said ankle cuff (116) being turnably mounted on said eccentric pin around an eccentric axis (of the eccentric part 144) offset in relation to said bolt axis.

13. Ski shoe according in particular to claim 1, 2, 3 or 4, characterized in that between ankle cuff (216) and said forward heel cup there is provided a pad, said pad limiting a forwardly-inclining movement of said ankle cuff (216).

14. Ski shoe according to claim 13, characterized in that said pad is elastically yielding and offers an increasing resistance as the forward-inclination increases.

15. Ski shoe according to claim 14, characterized in that said pad is arranged between the bottom edge of said ankle cuff in the area of the instep and in the area of the tongue of said forward heel cup.

16. Ski shoe according to claim 15, characterized in that said pad is adjustable.

17. Ski shoe according to claim 16 characterized in that said pad comprises one rigid pad (258) and one elastic, deformable pad part (254), said rigid pad part functioning in conjunction with an adjustable stop.

18. Ski shoe according to claim 8, including an instep strap, an instep seat on said forward heel cup, said instep strap including segments (328), said segments attached to the forward parts of said guides (319), said guide bearings comprise adjustment bearing (322) having bearing axes, said segments being adjustable, in relation to the respective guide (319) around said adjustment bearings (322) having adjustment bearing axes (322) which are substantially axis-parallel to the axes of the guide bearings (322) and said segments (328) being lockable in several angle positions around the axis of said adjustment bearings (322).

19. Ski shoe according to claim 18, characterized in that said bearing axis (22) coincide with said guide bearing axes (322).

20. Ski shoe according to 19, characterized in that each said guide is provided with at least one detent (380) projecting in the direction of said adjustment bearing axis (322), and the corresponding said instep strap segment (328) has at least one slot (382) for said detent (380).

21. Ski shoe according to claim 20, characterized in that said detents (380) are formed by bends in a sheet metal part forming said guide (319).

22. Ski shoe according to claim 21, characterized in that said segments (328) are substantially resistant to bending in their plane extending perpendicularly to the axis of said adjustment bearing (322), but can be bent out of said plane.

* * * * *